United States Patent [19]

Cox

[11] 4,291,932

[45] Sep. 29, 1981

[54] ELECTRICAL CONNECTOR RECEPTACLE ASSEMBLY

[75] Inventor: Larry R. Cox, Austin, Tex.

[73] Assignee: The United States of America as represented by the Secretary of the Navy, Washington, D.C.

[21] Appl. No.: 133,753

[22] Filed: Mar. 25, 1980

[51] Int. Cl.[3] ..... H01R 13/52

[52] U.S. Cl. ..... 339/60 R; 339/94 R

[58] Field of Search ..... 339/60, 61, 94

[56] References Cited

U.S. PATENT DOCUMENTS

| | | | |
|---|---|---|---|
| 2,440,279 | 4/1948 | Larkins, Jr. | 339/94 M |
| 2,740,098 | 3/1956 | Phillips | 339/94 |
| 3,121,598 | 2/1964 | Marasco | 339/60 R |
| 3,166,371 | 1/1965 | Brown et al. | 339/60 R |
| 3,445,805 | 5/1969 | McLoad | 339/89 |
| 3,611,255 | 10/1971 | Shroyer | 339/60 R |

FOREIGN PATENT DOCUMENTS 2362111 6/1961 France .

*Primary Examiner*—Joseph H. McGlynn

*Attorney, Agent, or Firm*—R. S. Sciascia; Sol Sheinbein

[57] ABSTRACT

A fluid tight, detachable underwater electrical connector assembly having a self-locking capability for use in connecting underwater hydrophones. The connector assembly comprises a female plug or receptacle housing, at least one electrical conductor, and a "feed-thru" tube leading from the receptacle housing for isolating the electrical conductor from a fluid environment. The receptacle housing is clear or substantially transparent thereby allowing visual inspection for leaks.

7 Claims, 3 Drawing Figures

ELECTRICAL CONNECTOR RECEPTACLE ASSEMBLY

BACKGROUND OF THE INVENTION

The present invention relates generally to electrical connectors and more particularly to a self-locking female plug or receptacle housing which is completely weather tight and can be readily visually inspected to determine its mated and sealed condition.

There is a long felt need in the electrical connector industry for completely sealed, self-locking, easily detachable, low cost connectors. Such connectors are required to removably connect underwater electronics devices such as hydrophones to other electronics equipment. The present invention is adapted to be used with a preexisting male connector or plug housing and replaces a female connector or receptacle formed of an opaque material and requiring an external locking device.

In review of the prior art, U.S. Pat. No. 2,740,098 to Phillips discloses a waterproof electrical connector utilizing O-ring seals 36 and clamping nuts 60 to form a secure connection. French Pat. No. 2,382,111 discloses an electrical cable connector comprising a receptacle with an outward tubular section and a reduced diameter inward tubular section. U.S. Pat. No. 3,611,255 reveals a moisture resistant electrical connector assembly having a series of ridges 29 and grooves 31 in a plug portion which mates with grooves 35 and protuberances 37 of the receptacle portion. A snap ring 41 forces the rings and grooves into close contact. U.S. Pat. No. 3,445,805 to McLoad discloses an electrical connector constructed of a high impact clear plastic material which permits the viewing of the inside of the connector to inspect for leaks.

Generally the electrical connectors in the prior art require external snap rings, ring nuts, or clamping nuts to secure them together. Furthermore, they are generally not adapted so that the electrical conductors are connected prior to insertion of the plug into the receptacle. Still further, the prior art connectors reviewed are not formed of an elastic clear plastic which provides visual inspection for leaks and a self-locking capability. Such deficiencies in the prior art are essentially circumvented by the device of the present invention.

SUMMARY OF THE INVENTION

Accordingly, the present invention provides an inexpensive, simple, strong, self-locking, fluid tight electrical connector receptacle assembly adapted for use with a plug counterpart. The receptacle assembly comprises three major components: the electrical conductors; a "feed-thru" tube; and a receptacle housing. The "feed-thru" tube surrounds the conductors in a spaced relation which permits axial movement of the conductors so that they may be connected with the plug prior to the insertion of the plug into the receptacle housing. The receptacle housing is formed of substantially transparent, resilient plastic with an annular recess which removably engages a correlative shoulder portion on the plug to provide a fluid tight, secure connection.

OBJECTS OF THE INVENTION

It is therefore an object of this invention to provide a simple, reliable, easily detachable, fluid tight electrical connector receptacle assembly.

A further object of the present invention is to provide an electrical connector receptacle assembly which can be easily and inexpensively manufactured.

Another object of this invention is to provide an electrical connector receptacle adapted to be used with a preexisting plug counterpart without the necessity of an external locking device.

Still another object of the present invention is to provide a fluid tight electrical connector receptacle assembly which allows visual inspection of its internal components while assembled.

Yet another object of the present invention is to provide a electrical connector receptacle with elastic properties for quick detachment capability.

Other objects and many of the attendant advantages of the present invention will be readily apparent as the invention becomes better understood by reference to the following detailed description with the appended claims, when considered in conjunction with the accompanying drawings.

DESCRIPTION OF THE PREFERRED EMBODIMENTS

Figure 1:
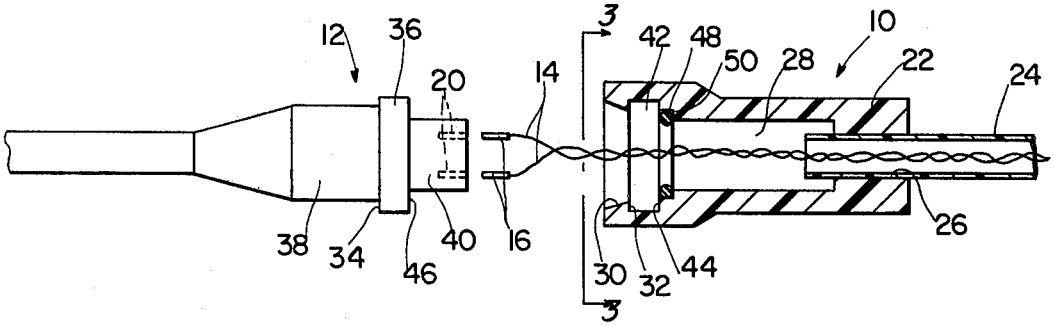
FIG. 1 is a cross-sectional view of the preferred embodiment of the electrical connector receptacle assembly of the present invention, shown in the disconnected mode with a correlative plug with which it is adapted to be used.
Figure 2:
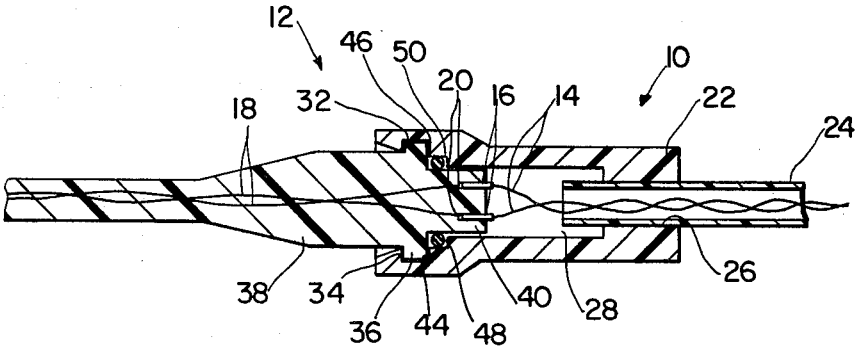
FIG. 2 is a cross-sectional view of the electrical connector receptacle assembly of FIG. 1, shown in the connected mode with a correlative plug (also appearing in cross-section) inserted.

Referring now to the drawings, wherein like reference characters designate like or corresponding parts throughout the several views, the preferred embodiment of FIG. 1 shows an electrical connector receptacle assembly 10 next to and disconnected from a plug housing 12. Receptacle assembly 10 includes conductors or wires 14 (also known in the trade as "pigtails") having enlarged ends or inserts 16. Although only two conductors 14 are shown, any number from one to over a hundred could be utilized depending upon the space constraints. As shown in FIG. 2, conductors 14 are connected with correlative conductors 18 in plug housing 12 by means of plug contacts 20. Since inserts 16 may be inserted into plug contacts 20 prior to the insertion of plug housing 12, this assures a positive, secure connection utilizing easily constructed components.

Surrounding conductors 14 in a fluid tight manner are a receptacle housing 22 and a tubular covering or "feed-thru" tube 24. Due to the seal between the tube 24 and receptacle housing 22, as well as the positioning of the opposite end of the "feed-thru" tube 24 above the water line or in a sealed relationship with another enclosure, the entry of water into the tube is prevented. "Feed-thru" tube 24 is constructed so as to surround conductors 14 in a spaced relation so as to allow free axial movement of conductors 14 within "feed-thru" tube 24. This construction facilitates the extension of conductors 14 from within receptacle 22 so that they may be easily connected to plug contacts 20 prior to the insertion of plug housing 12 into receptacle housing 22. Also, as is readily observable from the drawings, conductors 14 can be easily added, withdrawn or replaced within receptacle assembly 10 without necessitating the removal of receptacle housing 22 from "feed-thru" tube 24 by insertion through tube 24. The length of conductors 14 dictate the length of "feed-thru" tube 24. Tube 24 is molded in place at the same time the receptacle housing 22 is molded, and is of a vinyl construction. Although a substantial amount of internal spacing within "feed-thru" tube 24 allowing axial movement of conductors 14 is preferred, the construction could be simplified by molding in place the conductors 14 within covering 22 so that inserts 16 would then correspond to permanently affixed pins whereby connection would be made when plug housing 12 is inserted into receptacle housing 22. However, such an embodiment would not allow the advantages previously described associated with axially movable conductors 14.

Figure 3:
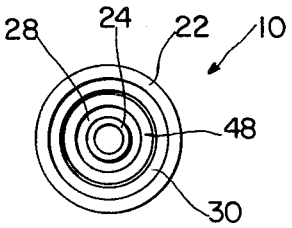
FIG. 3 is an end view of the electrical connector receptacle assembly as viewed from the line 3—3 of FIG. 1.

As shown in FIGS. 1–3, receptacle housing 22 has an aperture 26 when engages "feed-thru" tube 24 in fluid tight fashion as tube 24 extends partially into a generally cylindrical, cavity 28 generally in the center of the receptacle housing 22. Receptacle housing 22 is molded from a polyurethane plastic which is generally elastic. This provides a resilient encirclement of the tube 24 thereby assuring a fluid tight seal. Although polyurethane is preferred, materials with similar resilient and insulating qualities could be used to achieve similar results. The preferred polyurethane plastic is also substantially transparent, thereby allowing visual inspection of the interior of receptacle housing 22 while it is connected to the plug housing to detect leaks.

Receptacle housing 22 has a variety of elements which assure a secure, mating, fluid tight connection with plug housing 12. Immediately at the opening of receptacle housing 22 is a frusto-conical entrance surface 30. Due to the elasticity or resiliency of receptacle housing 22, an elastic deflection of entrance surface 30 will occur as plug housing 12 is inserted. Although entrance surface 30 is described as being frustoconical, the preferred configuration, other tapered or rounded surfaces may be substituted which provide a camming action as plug housing 12 elastically deforms the portion of receptacle housing 22 beneath the surface.

An important feature of the present invention is that no external retaining device is needed to secure plug housing 12 within receptacle housing 22. The built-in retaining means of the present invention includes a retaining surface 32 formed at the open or first end of receptacle housing 22. The retaining means essentially mates with a shoulder portion 36 located between a body portion 38 and a protruding portion 40 on plug housing 12. Shoulder portion 36, body portion 38, and protruding portion 40 are components of a preexisting plug housing 12 and are substantially cylindrical. The shoulder portion 36 defines axially facing engaging surface 34 and contacting surface 46. When plug housing 12 is connected to receptacle housing 22, as shown in FIG. 2, retaining surface 32 engages engaging surface 34 located on shoulder portion 36 of plug housing 12. Thus, one skilled in the art can readily appreciate that as the periphery of shoulder is thrust against entrance surface 30, which tapers inwardly from a diameter generally equal to the diameter of shoulder portion 36 to a diameter generally equal to the diameter of body portion 38, entrance surface 30 will resiliently deform to accommodate the passage of shoulder portion 36. Adjacent to retaining surface 32 is an annular recess 42 which encircles shoulder 36 of plug housing 12 in the connected mode shown in FIG. 2. While in the connected mode, abutment surface 44 is adjacent contacting surface 46 of plug housing 12. As shown in FIGS. 1 and 2, surfaces 32, 34, 44, 46 are substantially in planes perpendicular to central axes of the housings 12, 22. However, these surfaces may be somewhat frustoconical provided the correlative surface is correspondingly formed. Still, surfaces 32, 34, 44, 46 are preferably made in planes perpendicular to the axes due to the simplicity of construction and superior securing action as can be readily appreciated by those skilled in the art.

To further assure a fluid tight connection, an O-ring 48 is positioned within an annular groove or channel 50. Groove 50 is substantially cylindrical having a diameter less than annular recess 42 but greater than tubular cavity 28, both of which are also generally cylindrical. Due to the placement and elastic nature or O-ring 48, both contacting surface 46 and the surface of protruding portion 40 are abutted to create a sealing action in the connected mode. Also, since the annular groove 50 is generally only two sided, the O-ring 48 may be easily removed and replaced. However, although an O-ring 48 is preferred, another sealing element could be utilized, such as a resilient washer. Still, O-ring 48 is preferred due to its simplistic construction, elasticity and superior sealing effect. As shown in FIG. 2, the cavity 28, which is positioned generally to the right of the abutment surface 44, is substantially equal to or slightly larger than the protruding portion 40. This construction prevents undue radial flexure of the plug housing 12 and receptacle housing 22 in the connected mode which could lead to inadvertant disconnection. The extent that protruding portion 40 protrudes into tubular cavity 28 is such that some radial flexure between components 12, 22 is permitted to facilitate disconnection, but the axial length of the protruding portion 40, preferably approximately one fifth of the length of receptacle housing 22, is sufficient to prevent inadvertant disconnection. This length also assures positioning of the protruding portion 40 within the tubular cavity 28 during assembly.

In operation, to connect plug housing 12 with the electrical connector assembly 10 of the present invention, the wires or conductors 14 are withdrawn from the tubular cavity 28 and inserts 16 are placed in plug contacts 20 in housing 12. Once a secured connection is attained, plug housing 12 may be inserted into receptacle housing 22. Initially protruding portion 40 passes within O-ring 48. The shoulder 36 engages entrance surface 30 which provides a camming action as receptacle housing 22 deforms around shoulder 36. Upon further entry contacting surface 46 abuts O-ring 48 and abutment surface 44 as shoulder 36 comes to rest within annular recess 42. As shoulder 36 passes retaining surface 32, the entrance surface elastically returns to its normal frustoconical configuration and retaining surface 32 abuts engaging surface 34 on plug housing 12 to thereby prevent disengagement as shoulder portion 36 rests within annular recess 42.

Various modifications are contemplated and may obviously be resorted to by those skilled in the art without departing from the spirit and scope of the invention, as herein after defined by the appended claims, as only a preferred embodiment thereof has been disclosed.

What is claimed is:

1. A electrical connector receptacle assembly adapted to receive an electrical plug housing in a waterproof fashion wherein said plug housing has a longitudinal axis and includes at least one electrical contact, an axially protruding portion, a shoulder portion adjacent said protruding portion and a body portion adjacent said shoulder portion, said shoulder portion defining an engaging surface and a contacting surface located in axially spaced planes generally perpendicular to said longitudinal axis, said contacting surface being generally adjacent said protruding portion and said engaging surface being generally adjacent said body portion, said receptacle assembly comprising:

a receptacle housing means having a central cavity means for receiving at least a portion of said protruding portion;

at least one electrical conductor with an electrical conductor end thereon, and a feed-thru tube means for containing in a nonrestrictive manner said at least one electrical conductor to allow axial movement thereof, said receptacle housing means having a longitudinal axis and a first end defining an opening to said central cavity means for removable insertion of a portion of said plug housing, said receptacle housing means having a second end which sealingly engages the outer periphery of said feed-thru tube means, said first end including in sequential order, an entrance surface, a retaining surface which is adapted to abut said engaging surface of said plug shoulder portion, an annular recess, and an abutment surface for abutting the contacting surface of said plug shoulder portion, said retaining surface and said abutment surface being located in axially spaced apart planes generally perpendicular to said longitudinal axis, said receptacle housing means, further including a seal located generally adjacent said abutment surface, whereby when said electrical conductor end is first connected to said electrical contact and then said plug housing is inserted into said receptacle housing means, said contacting surface forms a fluid-tight engagement with said seal and said engaging surface engages said retaining surface thereby resisting disengagement of said plug housing and said receptacle housing means.

2. The invention as set forth in claim 1 wherein said seal is an O-ring removably positioned in an annular groove in said receptacle housing means located axially intermediate said abutment surface and said central cavity means.

3. The invention described in claim 1 wherein the feed-thru tube means is adapted to carry plural electrical conductors therethrough in axial unrestraint whereby in assembly said conductors are adapted to be first connected to electrical contacts in the electrical plug housing followed by axial assembly of the plug housing with the receptacle housing means.

4. The invention as set forth in claim 1 wherein said receptacle housing means is generally made of substantially elastic insulating material.

5. The invention as set forth in claim 4 wherein said insulating material is substantially transparent.

6. The invention as set forth in claims 1 or 4 wherein said entrance surface is frustoconical and resilient.

7. The invention described in claims 1 or 4 wherein said feed-thru tube means is made of a vinyl material.

* * * * *